US005791503A

United States Patent [19]

Lyons

[11] Patent Number: 5,791,503

[45] Date of Patent: Aug. 11, 1998

[54] NURSING BOTTLE WITH ANTI-AIR INGESTION VALVE

[76] Inventor: Richard A. Lyons, 4010 E. Young St., Tulsa, Okla. 74115

[21] Appl. No.: 596,497

[22] Filed: Feb. 5, 1996

[51] Int. Cl.[6] ..... A61J 9/00; A61J 9/04

[52] U.S. Cl. ..... 215/11.5; 315/11.1; 315/11.4; 315/902

[58] Field of Search ..... 215/11.1, 11.4, 215/11.5, 902

[56] References Cited

U.S. PATENT DOCUMENTS

| | | | |
|---|---|---|---|
| 943,951 | 12/1909 | Moody . | |
| 980,184 | 1/1911 | Ballard et al. . | |
| 2,107,442 | 2/1938 | Hughes | 215/11.4 |
| 2,372,281 | 3/1945 | Jordan | 215/11 |
| 2,597,483 | 5/1952 | Head, Sr. | 251/127 |
| 2,745,568 | 5/1956 | Newton | 215/11.4 X |
| 2,827,191 | 3/1958 | Baracate | 215/11.4 |
| 2,876,772 | 3/1959 | Witz | 128/252 |
| 2,979,078 | 4/1961 | Witz | 137/533 |
| 3,346,133 | 10/1967 | Herdman | 215/11.1 |
| 3,385,297 | 5/1968 | Yazaki | 128/252 |
| 3,722,728 | 3/1973 | Yazaki | 215/11 |
| 3,946,888 | 3/1976 | Tonkin | 215/11.5 |
| 4,339,046 | 7/1982 | Coen | 215/11.5 |
| 4,401,224 | 8/1983 | Alowso | 215/11.5 |
| 4,676,386 | 6/1987 | Philaphongphanich | 215/11 |
| 4,754,887 | 7/1988 | Ou | 215/11.4 |
| 4,898,291 | 2/1990 | Sailors | 215/11.4 |
| 5,150,800 | 9/1992 | Sarter et al. | 215/11.4 |
| 5,234,117 | 8/1993 | Garvin | 215/11.4 |
| 5,295,597 | 3/1994 | Green | 215/11.4 |
| 5,301,825 | 4/1994 | Di Scala et al. | 215/11.1 |
| 5,474,193 | 12/1995 | Larsson | 215/11.5 X |

FOREIGN PATENT DOCUMENTS

| | | | |
|---|---|---|---|
| 562009 | 8/1958 | Canada | 215/11.5 |
| 860757 | 1/1971 | Canada | 215/11.1 |
| 220586 | 4/1910 | Germany | 215/11.5 |
| 594286 | 5/1959 | Italy | 215/11.1 |
| 2190596 | 11/1987 | United Kingdom | 215/11.5 |

*Primary Examiner*—Sue A. Weaver

*Attorney, Agent, or Firm*—Head, Johnson & Kachigian

[57] ABSTRACT

An infant nursing bottle includes a partially sealable check valve between the top of the bottle and the feeding nipple, whereby equalizing air may enter the bottle after the suction phase while the baby pauses.

20 Claims, 5 Drawing Sheets

NURSING BOTTLE WITH ANTI-AIR INGESTION VALVE

BACKGROUND OF THE INVENTION

This invention relates to improvements in baby's nursing bottle; and in particular, improvements in a valved nipple which facilitates extraction of the milk or other liquid from a nursing bottle by an infant.

Conventional nursing baby bottles have been known because of their action to create excessive air swallowing which has been attributed to aerophagia, or the so-called "colic". In particular, this has been true of conventional nipples having a relatively small hole or holes in the tip, the hollow portion of the nipple communicating with the interior of the body to a relatively large opening substantially the size of the mouth of the bottle. The baby exerts a biting or gumming action on the nipple. The liquid in the nipple is more readily forced back into the bottle than through the small hole or holes in the tip. This forces the baby to exert greater sucking action which results in the swallowing of excessive amounts of air.

A variety of valves have heretofore been proposed for nipples to control the back flow of liquid, but are complicated, expensive, difficult to clean, and in many instances, unreliable in operation.

SUMMARY OF THE INVENTION

A primary object of the present invention is to provide an improved nursing bottle which will prevent excessive air swallowing by the baby.

A further object of the invention is to provide a removable and/or replaceable valve element that will operate within a standard nursing bottle and nipple construction.

A further object of the invention is to provide a nursing bottle which is capable of controlling the amount of air to be drawn into the bottle so as to enable the infant to always drink a liquid in accordance with his or her sucking ability.

Another object of the invention is to provide a nursing bottle in which the liquid therein is prevented from flowing out through the nipple when not being used by the infant.

Specifically, the invention is directed to a nursing bottle for infant which consists of several elements including a common bottle with a mouth or opening, a cap, and a common nipple with an aperture at the end for the extrusion of milk by the action of the infant. Sealably retained between the nipple and the cap is a disk with a flexible valve member which may be of an 'umbrella' type or a diaphragm type which acts as a one-way partially sealed check valve allowing the liquid to flow in one direction while the infant is in the feeding position. Ribs are provided as a part of the valve or diaphragm to allow equalizing air to return past the check valve into the bottle between sucking.

These and other objects and purposes of the invention will become apparent from the following description, accompanying drawings and appended claims.

DETAILED DESCRIPTION OF THE PREFERRED EMBODIMENT

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

Figure 1:
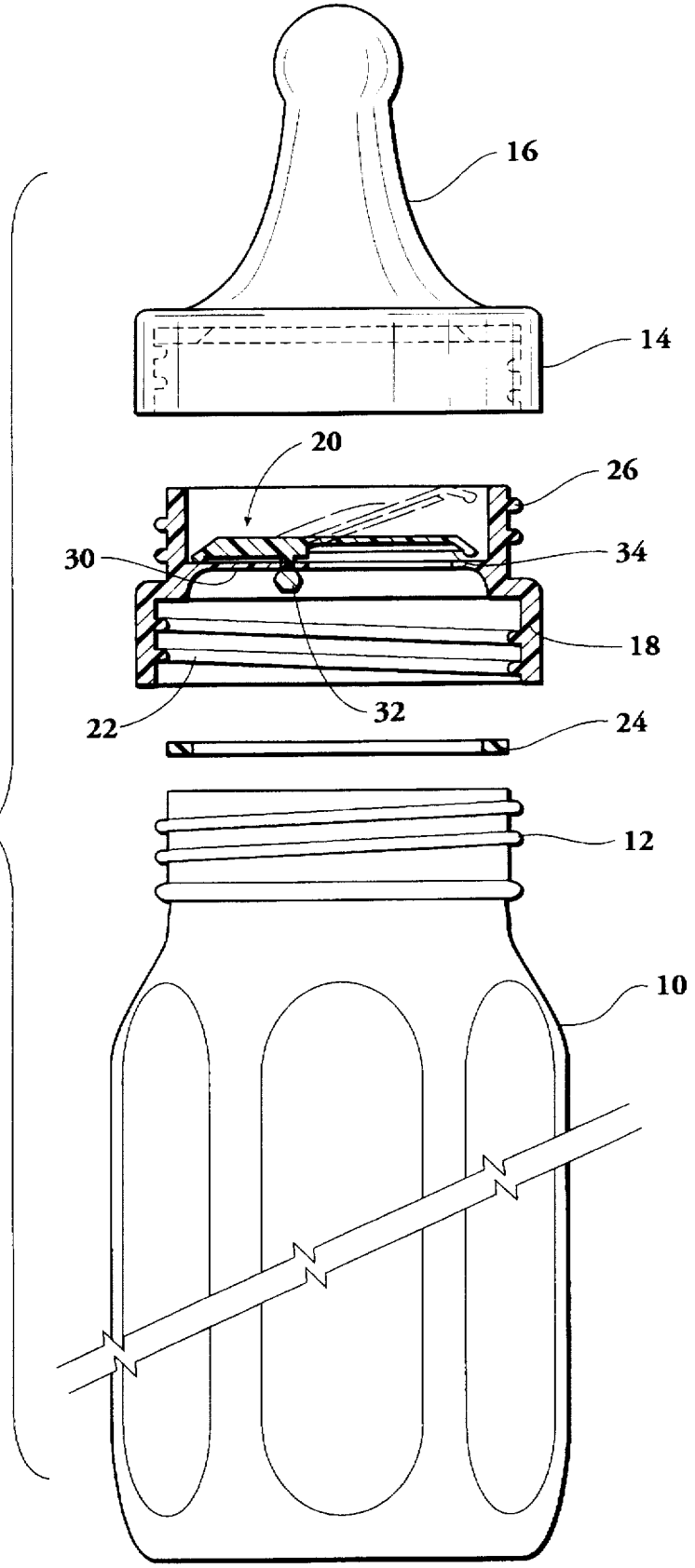
FIG. 1 is an exploded view, partly in cross section, of an infant nursing bottle according to one embodiment of this invention.
Figure 2:
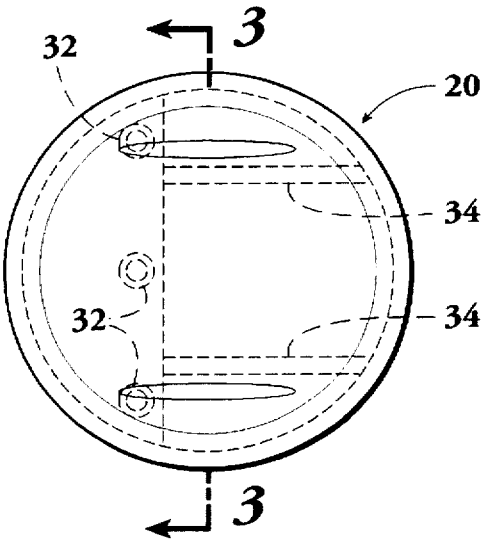
FIG. 2 is a top view of the flexible valve according to the modification of FIG. 1.
Figure 3:
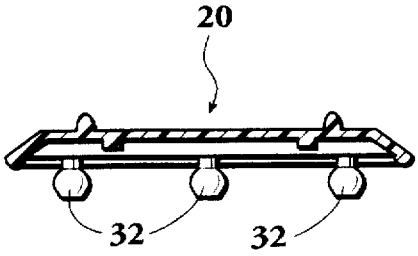
FIG. 3 is a sectional view taken along the line 3—3 of FIG. 2.

Referring now particularly to FIGS. 1–3, bottle 10 is of a conventional type having threads 12 at its top which is normally closed by a cap 14 and conventional nipple 16. In this embodiment an adaptor cap 18 is provided to support the check valve generally designated by the numeral 20. The adaptor cap includes internal threads 22 which are adapted to match the bottle threads 12. A seal ring 24 may be provided. The exterior threads 26 are provided in the upper part of the adaptor cap to mate with the internal threads of cap 14. The valve 20 of this embodiment is comprised of a flexible plastic material and is adapted to be retained to a rigid diaphragm 30 by means of a plurality of protuberances 32 which are snapped through the rigid diaphragm or disk 30 which creates a hinge line 36 about which flexible valve 35 hinges. A plurality of ribs 34 are provided beneath the flexible valve for the purpose of preventing a perfect seal of the valve to the rigid disk 30 and thus, allow the entrance of air back into the bottle when the infant stops feeding. The ribs include a tapered or rounded ends 37.

Figure 4:
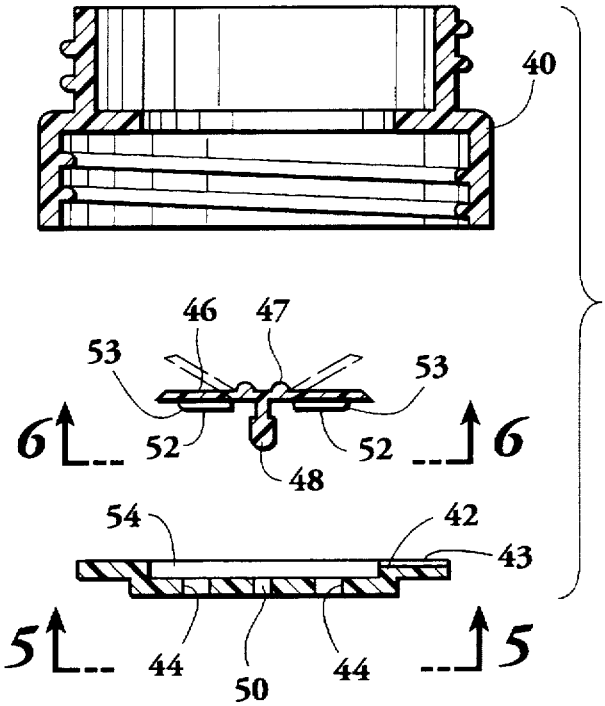
FIG. 4 is an exploded view of another embodiment of this invention.
Figure 6:
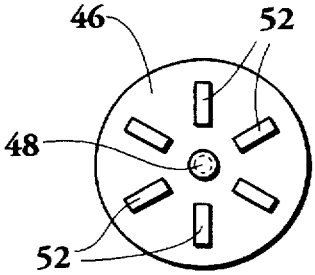
FIG. 6 is a bottom elevational view of an umbrella type valve taken along the line 6—6 of FIG. 4.
Figure 5:
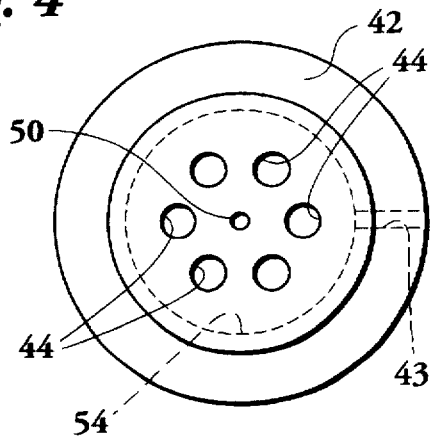
FIG. 5 is a bottom elevational view taken along the line 5—5 of FIG. 4.

FIGS. 4, 5 and 6 depict an alternate embodiment of the invention, which in this instance utilizes the adapter cap 40, a rigid disk 42 having a plurality of slots or openings 44 therein. In this embodiment an 'umbrella' type valve 46 is provided to flex downstream or toward the nipple as shown dotted, about a circular hinge 47. In one embodiment a radial air passage 43 is provided. The valve includes a protruberance 48 which is adapted to be snapped into center opening 50 of the rigid disk 42. On the underneath side of the flexible valve 46 are a plurality of ribs 52 with tapered or rounded ends 53 as best shown in FIG. 6. The rigid disk 42 includes in one embodiment a recessed area 54 to receive the flexible valve 46.

Figure 7:
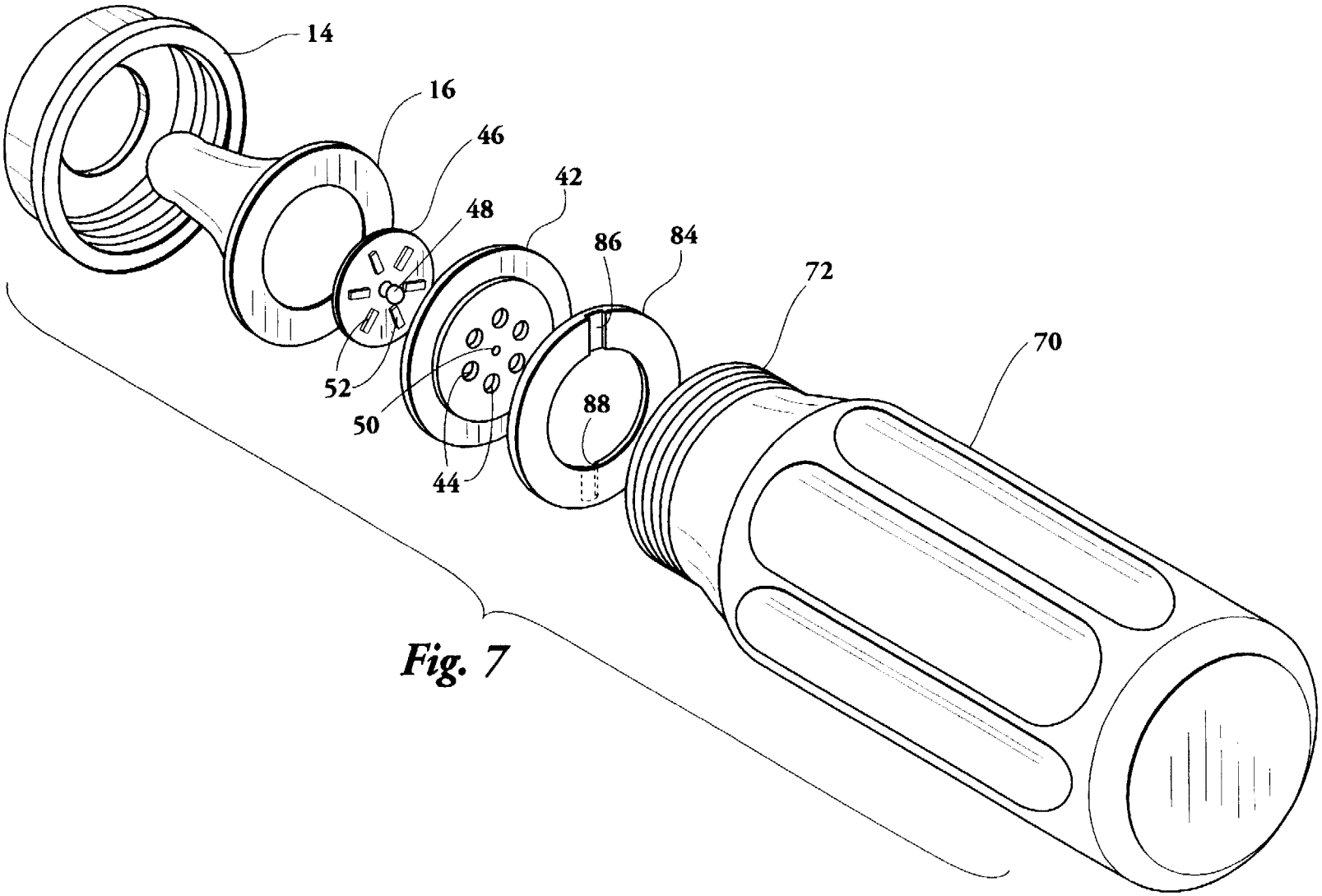
FIG. 7 is an exploded view of an assemblage according to one embodiment of the invention.

FIG. 7 is an exploded view of an assemblage without the adapter cap 40 which includes a bottle 70, a rigid disk 42 as shown in FIGS. 4 and 5 which rests on the top 72 of the bottle. The flexible 'umbrella' type valve 46 will be assembled to the rigid disk that is heretofore described. The bulbous nipple 16, of standard configuration, is inserted into the cap 14, the assemblage of which provides a sealed infant feeding bottle except for the action of the valve.

Figure 8:
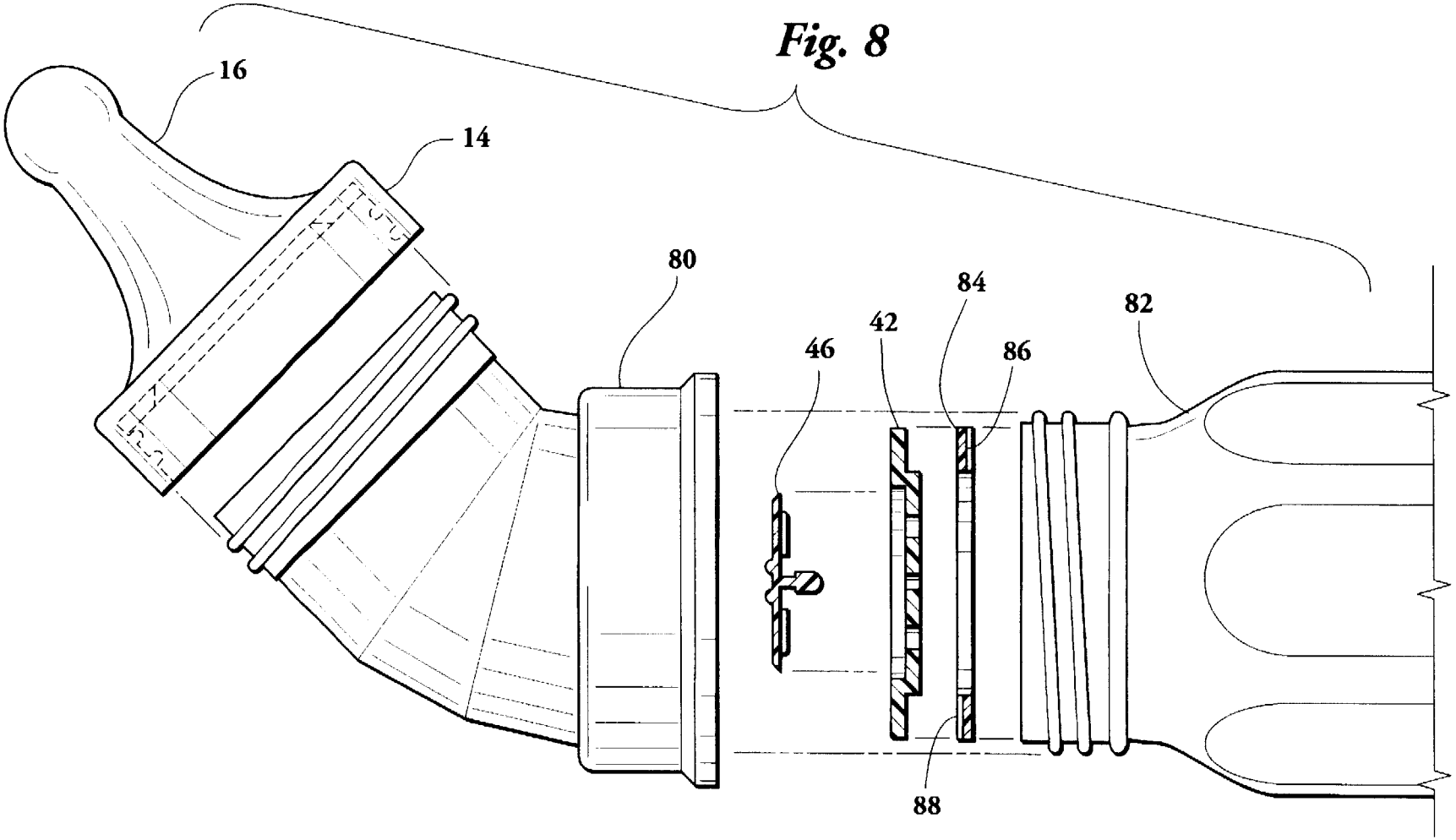
FIG. 8 is a partial exploded view showing another embodiment of the invention.
Figures 9, 10, 11:
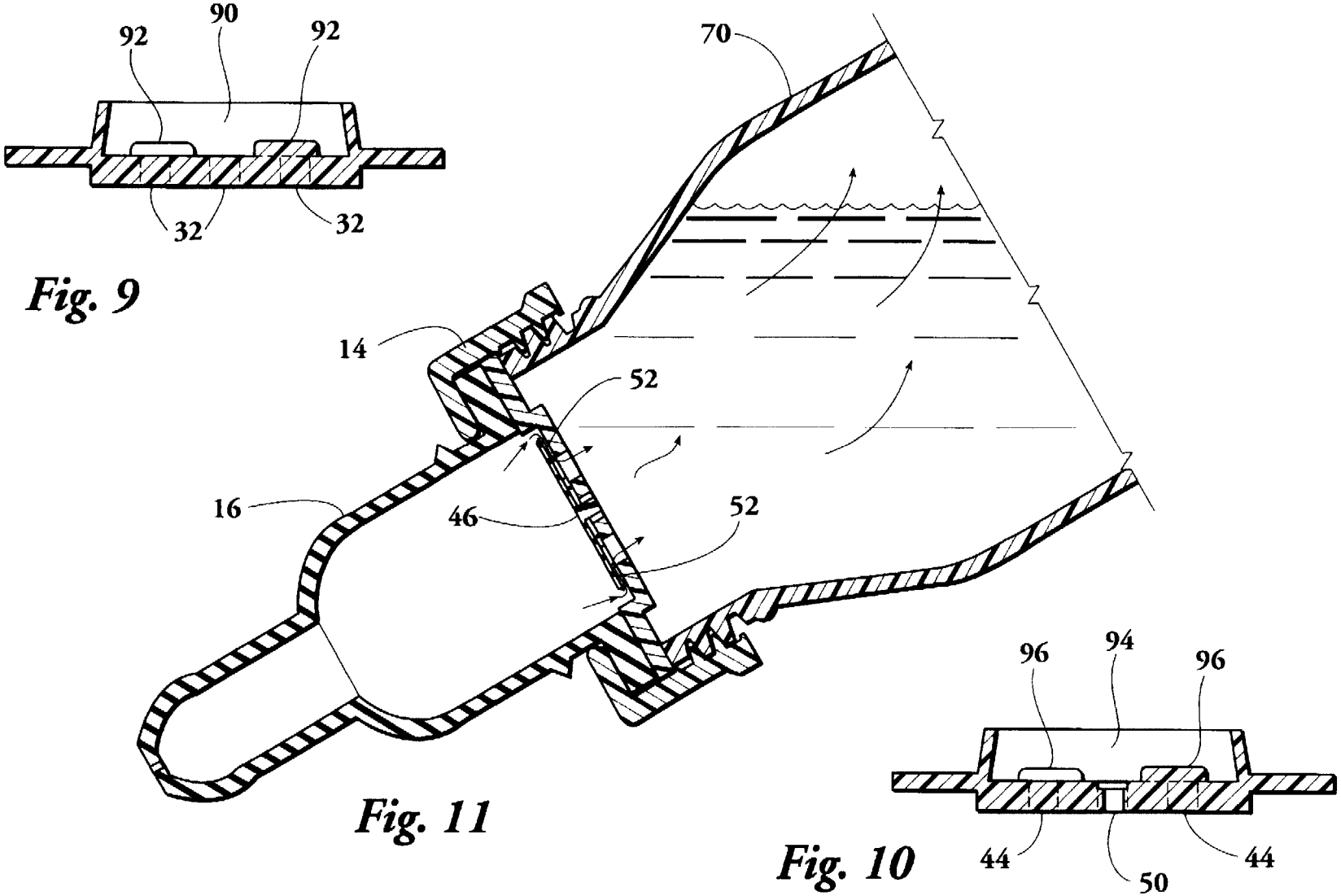
FIG. 9 is a side elevational view of another form of rigid disk for use with the flapper type of valve.
FIG. 10 is a side elevational view of one form of rigid disk for use with the umbrella form of valve.
FIG. 11 is a partial sectional view depicting the flow of air in the non-sucking position.

FIG. 8 is another embodiment of the invention showing a 45° adapter 80, one end of which can be threadably attached to bottle 82 while the other end is attached to a conventional cap 14 and nipple 16. Intermediate, the connection between the bottle and the 45° adapter is the valve of this invention such as shown in FIGS. 4–8. There are instances where some nipples such as so called "dripless nipples" will not allow air to reenter the bottle during feeding as shown in FIG. 11. In that instance, a separate ring washer 84 having at least one radial slot 86 on one side and a radial slot 88 on the other side will permit air to enter the bottle via the threaded connection between the cap and bottles instead of through the nipple. In another embodiment, not shown, at least one slot may be included as a part of the flange of disk 42 that permits air to reenter from the outside during the non-suction phase of feeding.

FIG. 9 is a side elevational view of the form of rigid disk for utilization with the diaphragm type of valve such as shown in FIGS. 1–3 which includes an upwardly and inwardly rib 90 having projections 92, ribs 34 as shown in FIGS. 1 and 2.

FIG. 10 is a side elevational view in cross section of a rigid disk for use with the 'umbrella' type valve which is described in FIGS. 4–7. In this embodiment an upwardly and inwardly rib 94 is provided and in lieu of the ribs 52 shown in FIG. 6, the rigid disk may include projections 96.

FIG. 11 is a depiction of the use of the infant feeding bottle while in the desired feeding position, i.e., about 45°. In the operation of the device and before the feeding begins by the infant, while the bottle is at an angle, liquid is forced from the base to the neck of the bottle as shown in FIG. 11. Liquid rests on the back of the flexible valve which causes it to form a seal. Liquid is held in this position because of a semi-vacuum seal of the check valve until exertion of the nipple occurs by the infant sucking or 'gumming' the nipple. During feeding the exertion of the baby's lips on the nipple forces the 'umbrella' valve 46 to open towards downstream with resulting liquid forced through the holes 44 of the rigid disk filling the nipple and forcing the liquid into the baby's mouth. When the infant stops to take a breath, the valve 46 closes and the flow of liquid stops. Before the baby begins to suck again, air must return into the bottle which keeps the baby's suction greater than the vacuum in the bottle and thus, preventing the nipple from collapsing. This air flow occurs, as shown by the arrows in FIG. 11, with the valve closed to form a seal against the front of the diaphragm with the air travelling through the space created by the ribs 52, i.e., underneath the flexible valve travelling through the holes 44 of the fixed disk into the bottle where the process is repeated.

The primary advantage of the invention rests in a partially sealed check valve that permits the infant to control how much liquid he or she needs by how hard or soft the action of sucking or gumming of the nipple. The flexible valve controls liquid in the nipples from leaking or dripping, since the air flow only comes in one way with the valve creating a back vacuum inside the nipple holding the liquid until the greater force, i.e., the baby's sucking on the nipple opens the valve and the liquid is then released. The advantages of such a system prevents tooth decay, ear infections, and colic. Especially important is the advantage that while a infant feeds themselves to sleep on a regular basis, there is no entrance of liquid into the mouth. If the baby is conscious enough to suck on the nipple while he is asleep, he is conscious enough to swallow.

What is claimed is:

1. A baby bottle with a threaded tops having assembled thereto:

a threaded cap having a nipple therein;

a rigid disk between said nipple and said bottle, said disk having a valve seat with at least one opening thereacross;

a flexible valve positioned between said disk and said nipple and supported by said disk over said valve seat, said valve biased in a substantially closed position toward said valve seat; and at least one rib between said valve and said valve seat whereby in said substantially closed position said valve is prevented from fully closing, said rib defining at least one air passageway for permitting air to reenter said bottle when said valve is in said substantially closed position.

2. The baby bottle of claim 1 wherein said valve seat is recessed below a coaxial rim.

3. The baby bottle of claim 2 wherein said disk includes a radial air passage across said rim.

4. The baby bottle of claim 1 wherein said rigid disk includes a plurality of openings thereacross, and said flexible valve is a disk retained in said rigid disk and normally covering said openings and wherein each said rib is between said openings.

5. The baby bottle of claim 1 wherein said at least one rib is on said flexible valve.

6. The baby bottle of claim 1 wherein said at least one rib is on said rigid disk.

7. The baby bottle of claim 1 wherein each said rib has rounded ends.

8. The baby bottle of claim 1 wherein said at least one opening is a semi-circular opening and said flexible valve is hingedly retained to said rigid disk.

9. The baby bottle of claim 1 including a ring washer between said threaded top and said rigid disk, said washer having a radial slot on at least one of the sides of said washer.

10. The baby bottle of claim 1 wherein said flexible valve is an umbrella type pivotal about a central hinge ring.

11. A baby bottle having a threaded top, a threaded cap, a nipple having a bulbous head and a flange which is sealably secured at the top by an overhanging lip portion of said cap, the improvement comprising:

a rigid disk sealably positioned between the top of said bottle and said flange, said disk having at least one opening thereacross, a flexible valve covering said opening in one position, said valve being flexible toward said nipple to fully open said opening in a second position, and at least one rib defining at least one air passageway between said flexible valve and said rigid disk said rib to prevent fully closing of said opening when in said one position.

12. The baby bottle of claim 11 wherein said rigid disk includes a plurality of openings thereacross, and said flexible valve is a disk retained in said rigid disk and normally covering said openings and wherein each said rib is between said openings.

13. The baby bottle of claim 11 wherein said at least one rib is on said flexible valve.

14. The baby bottle of claim 11 wherein said at least one rib is on said rigid disk.

15. The baby bottle of claim 11 wherein said at least one opening is a semicircular opening and said flexible valve is hingedly retained to said rigid disk.

16. The baby bottle of claim 11 including a ring washer between said threaded top and said rigid disk, said washer having a radial slot on at least one of the sides of said washer.

17. The baby bottle of claim 11 wherein said flexible valve is an umbrella type pivotal about a central hinge ring.

18. The baby bottle of claim 11 wherein said rigid disk comprises a recessed area below a coaxial rim.

19. The baby bottle of claim 18 wherein said disk includes a radial air passage across said rim.

20. A bottle with a threaded end for dispensing liquid, said bottle having assembled thereto:

a threaded cap having a nipple therein;

a rigid disk between said nipple and said bottle, said disk having a valve seat with at least one opening thereacross;

a flexible valve positioned between said disk and said nipple and supported by said disk over said valve seat, said valve biased in one position toward said valve seat; and at least one rib between said valve and said valve seat whereby in said one position said valve is prevented from fully closing, said rib defining at least one air passageway for permitting air to reenter said bottle when said valve is in said substantially closed position.

* * * * *